United States Patent [19]

Barnby

[11] 4,135,559

[45] Jan. 23, 1979

[54] WATER SQUIRT TOY AND FILL VALVE COMBINATION

[76] Inventor: Donald W. Barnby, 1111 Army Navy Dr., Arlington, Va. 22202

[21] Appl. No.: 667,751

[22] Filed: Mar. 17, 1976

[51] Int. Cl.[2] ..... B65B 3/04

[52] U.S. Cl. ..... 141/18; 46/1 E; 141/25; 141/362; 273/106 R

[58] Field of Search ..... 137/519; 141/2, 18, 141/21–25, 348, 349, 351, 352, 363, 114, 353, 360–362; 222/79, 174, 189, 105, 212–215, 210, 386.5, 469, 517, 78; 251/321, 325, 353; 273/86 R, 105.4, 106 R; 46/1 E

[56] References Cited

U.S. PATENT DOCUMENTS

| | | | |
|---|---|---|---|
| 2,629,516 | 2/1953 | Badham | 222/212 X |
| 3,356,265 | 12/1967 | Wiggins | 222/183 X |
| 3,848,808 | 11/1974 | Fetty et al. | 222/78 X |

FOREIGN PATENT DOCUMENTS

| | | | |
|---|---|---|---|
| 28633 | 1/1924 | France | 141/351 |

*Primary Examiner*—Richard E. Aegerter
*Assistant Examiner*—Frederick R. Schmidt
*Attorney, Agent, or Firm*—Leitner, Palan, Martin & Bernstein

[57] ABSTRACT

A water squirt toy apparatus including a combination of a water squirt toy and a special filling valve which function together cooperatively.

The water squirt toy includes a resiliently expansible tubular member serving as a water reservoir and encased within a rigid tubular support member, and a manually operated, lever-type normally closed valve mechanism operatively associated with the expansible member for permitting or preventing fluid discharge therefrom by compressing or pinching the same. The forward end of the expansible member is fixedly, but removably, secured to a discharge opening. The filling valve is particularly structured for fluidically mating with a conventional hose bib or hose as well as with the discharge opening in order to permit easy and rapid filling and refilling of the expansible member with water. The discharge opening may also mate directly with the hose bib or hose without the special valve. An injector is also provided for operative connection to the filling valve for injecting chemicals into the water supply whereby the discharged streams will coalesce and exhibit reduced separation so as to be discharged over significantly greater distances; and amusement apparatus which is particularly adaptable for use with the water squirt toy is also disclosed.

13 Claims, 10 Drawing Figures

WATER SQUIRT TOY AND FILL VALVE COMBINATION

BACKGROUND OF THE INVENTION

1. Field of the Invention

The present invention relates generally to water amusement devices, and more particularly to a water squirt toy and amusement apparatus to be used therewith, the toy being particularly capable of easy and rapid filling and refilling by virtue of a specially designed and cooperative filling valve which enable the squirt toy to be used in fast action games that would not otherwise be practical. Said water squirt toy is also capable of discharging an accurately defined stream of water, over considerably extensive distances, whereby the same is capable of being utilized in conjunction with amusement apparatus when operating the same.

2. Description of the Prior Art

Water squirt toys are, of course, well-known within the prior art, and it is generally conceded that the most prevalent exponent of such type of toy is the water-pistol or water-gun. Disregarding, for the moment, however, the innumerable varieties, as well as the total number of sales, of such toys available, and recorded, respectively, within the current toy market place, such toys exhibit several technological and operational disadvantages, and there thus exists a substantial need for a new type of water squirt toy.

Water squirt toys of the water-pistol or water-gun type, for example, normally include some type of finger-actuated, trigger-operated pump mechanism which causes a predetermined amount of water to be discharged in a defined stream through a constricted opening or nozzle disposed in the front of the toy, whereby the discharged stream may be expelled in the direction in which the toy is pointed during the use of the same. The trigger-type pump mechanisms, however, are often difficult to operate, especially by means of a young child, and as such mechanisms are often made of plastic material, or encased within plastic housings, the same are quite susceptible to breakage whereby the squirt toy can no longer be used.

Furthermore, as the pump mechanism is of the intermittently actuated type, the water discharged thereby comprises only a predetermined quantity and therefore the use of such water toys is quite limited and the same cannot in fact be readily employed within games requiring a substantially continuous discharge stream. Still further, as the reservoir capacity of such water toys is normally small, prolonged use of such toys within particular games is not deemed readily practicable, or alternatively, at best, frequent refilling of the toys is necessitated, however, as such toys also exhibit a small, plug-type opening leading into the reservoir, filling or refilling of the same is awkward, difficult, quite time-consuming, and messy. The ranges of such apparatus also tends to be limited, large streams of water are not available, and the stream size cannot be varied.

Still yet further, while other types of water squirt toys may exhibit some of the desirable features noted hereinabove, such as, for example, being capable of discharging a continuous stream of water over a considerable range, such apparatus remains difficult and messy to fill, have no means to precisely vary the size of the discharged stream, and the same are capable of holding a moderate supply of water. In addition, such apparatus are often difficult or awkward to hold, carry, aim, and shoot, because of the flexibility thereof.

SUMMARY OF THE INVENTION

Accordingly, it is an object of the present invention to provide a new and improved water squirt toy.

It is also an object of the present invention to provide a new and improved water squirt toy and valve apparatus therefor for facilitating filling of the same with its reservoir supply of water.

Still another object of the present invention is to provide a new and improved water squirt toy and valve apparatus therefor whereby filling of the water squirt toy reservoir is able to be accomplished in a rapid and simplified manner, thereby making practical the use of the water squirt toy in a variety of games which require easy and rapid refilling.

Yet another object of the present invention is to provide a new and improved water squirt toy and an injector therefor for injecting fluid into the water whereby such fluid reduces the tendency of the discharged stream to separate and which also reduces the flowing friction and turbulence thereof, thereby permitting greater range to be achieved.

Still yet another object of the present invention is to provide a new and improved amusement apparatus which is particularly adaptable for use with the water squirt toy of the present invention.

Yet still another object of the present invention is to provide a new and improved water squirt toy which is operable in a simplified manner, even by young children.

A further object of the present invention is to provide a new and improved water squirt toy which is capable of being operated in such a manner as to provide a continuous stream of water thereby rendering the same particularly adaptable for use with a diverse variety of amusement apparatus.

A still further object of the present invention is to provide a new and improved water squirt toy which is not readily susceptible to wear and therefore exhibits a prolonged service life.

A yet further object of the present invention is to provide a new and improved water squirt toy which has a water reservoir which is substantially greater volume than those of conventional squirt toys.

A still yet further object of the present invention is to provide a new and improved water squirt toy which is safe to operate.

An additional object of the present invention is to provide a new and improved water squirt toy which is easy to hold, carry, aim, and shoot.

A still additional object of the present invention is to provide a new and improved water squirt toy the discharge characteristics of which are capable of being varied in order to accommodate its use in conjunction with different amusement apparatus.

The foregoing and other objectives of the present invention are achieved through the provision of a combination water squirt toy and filling valve which cooperate together to provide the desired functioning. The water squirt toy includes a resiliently expansible tubular member serving as a water reservoir and disposed within a rigid tubular support member, and a manually operated, lever-type normally closed valve mechanism operatively associated with the expansible member for permitting or preventing fluid discharge therefrom by compressing or pinching the same. The forward end of the expansible member is fixedly, but removably, secured to a discharge opening, and a filling valve is particularly structured for fluidically mating with a conventional hose bib or hose as well as with the discharge opening in order to permit filling of the expansible member with water, although the discharge opening may also directly mate with a hose bib or hose without the need for using the valve. An injector is also provided for fluidically connecting to the filling valve for injecting chemicals into the water supply whereby the tendency of the stream discharged from the water squirt toy to separate is reduced, and the friction and turbulence of flow are also reduced so as to discharge the water over greater distances. Amusement apparatus which is particularly adaptable for use with the water squirt toy is also disclosed.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE ILLUSTRATED EMBODIMENTS

Figure 1:
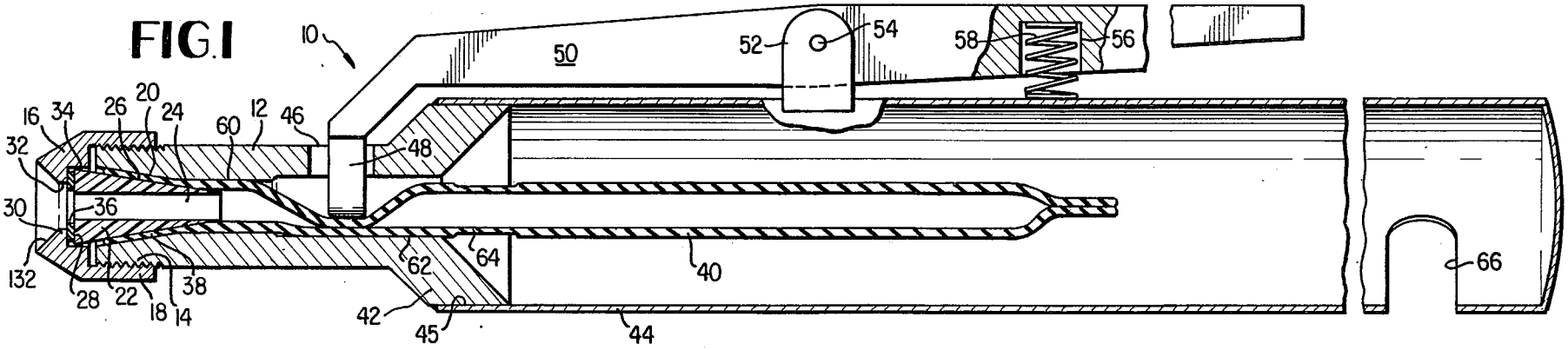
FIG. 1 is a side elevation view, partly in cross-section, of one embodiment of a water squirt toy constructed in accordance with the present invention and showing its cooperative parts.

Referring now to the drawings, and more particularly to FIG. 1 thereof, there is illustrated one embodiment of a water squirt toy, generally indicated by the reference character 10, and which includes an elongate, substantially annular body member 12, the forward portion 14 of which is externally threaded, and a substantially annular, stepped nose piece 16, the largest diameter axially extending wall portion 18 of which is internally threaded so as to threadedly mate with portion 14 of body member 12.

The internal peripheral surface 20 of the forward portion 14 of member 12 is tapered such that the same is radially divergent as one proceeds forwardly along the longitudinal axis of member 12, and a frusto-conical compression cone 22, having an axial bore 24 formed therethrough which, as will be apparent hereinafter, serves as the water discharge opening, is adapted to be interposed between the body member 12 and the nose piece 16. The outer conical surface 26 of cone 22 has an inclination, relative to the longitudinal axis thereof, which is substantially the same as that of the inner surface of portion 14 of member 12 so as to mate therewith, and the base 28 of cone 22 is adapted to be seated upon a radially inwardly projecting flange 30 which is defined between the smallest diameter axially extending wall portion 32 of the stepped nose piece 16 and an intermediate diameter axially extending wall portion 34 of nose piece 16, while the forward portion of cone 22 is radially confined within the axially extending wall portion 34 of stepped nose piece 16.

An annular gasket 36 is interposed between the base portion 28 of cone 22 and the flange portion 30 of nose piece 16 in order to seal the forward portion of the toy 10 when filling the same with water, and the forward portion 38 of a longitudinally extending tubular member 40, open at the forward end thereof and closed at the rear end thereof, is likewise interposed between the conical surfaces 20 and 26 so as to be clamped therebetween when the surfaces 20 and 26 are mated as a result of the nose piece 16 being threadedly engaged upon the threaded portion 14 of body member 12, the cone 22 thereby being disposed interiorly of the member 40 such that the bore 24 of cone 22 is fluidically connected to the interior portion of tube 40 which, as will become more apparent hereinafter, serves as the water reservoir of the toy 10.

It is of course possible that the clamping of the tubular member may be accomplished in another, although similar manner, such as, for example, the fact that the member 40 may be provided with radially extending flanges, not shown, which may then of course be grasped or clamped between suitably configured members or portions which would be provided in lieu of the tapered surfaces 20 and 26 of members 12 and 22, respectively. Still further, it might be additionally noted in conjunction with the structure of tubular member 40 that the closed end thereof may be formed in a variety of ways, such as, for example, being molded closed, however, the same might also be knotted at such end, or alternatively, may be pinched closed and fused or glued, or a plug might be inserted within the one end and fused or glued to the tube structure.

Tubular member 40 is adapted to be resiliently deformable, and is particularly adapted to be radially and axially expansible, and may consequently be formed of a suitable rubber material. Body member or housing 12 includes a rear portion 42 which is radially divergent as one proceeds rearwardly along the longitudinal axis of member 12, and a rigid tubular or cylindrical support member 44, closed at the rear end thereof, is fixedly secured, at its forward end, to axially extending outer surface portion 45 of the rear portion 42 of body member 12, the inner diameter of tubular support member 44 being substantially the same as, or slightly larger than, the outside diameter of portion 45 of body member 12, whereby suitable integral mating therewith is facilitated.

Body member 12 is further provided with an aperture 46 within the upper wall portion thereof, and a radially inwardly projecting member 48 of an axially extending lever 50 is adapted to pass through aperture 46 and be disposed interiorly of body member 12 so as to operatively engage tubular member 40.

Upstanding ear or bracket members 52 are integrally secured upon the upper, external surface of tubular support member 44 and upon opposite sides of the vertical plane including the longitudinal axis thereof, and lever 50 is pivotally supported within bracket members 52, and relative to support member 44 and body member 12, by means of a pivot pin 54. The lever 50 is also provided with a blind bore 56 at an axial position disposed rearwardly of brackets 52 and pivot pin 54, and a radially disposed coil spring 58 is disposed within bore 56 so as to be interposed between lever 50 and the upper, external surface of tubular support member 44, spring 58 normally biasing lever 50 about pivot pin 54 such that the projecting member 48 operatively engages tubular member 40 so as to radially compress and pinch the same closed, the lever assembly therefore serving as a normally closed valve mechanism.

In conjunction with the aforenoted structure, it will be additionally noted that the inner diameter of axially extending bore-defining wall portion 60, of the body member 12, which is disposed axially rearwardly of forward portion 14, is substantially the same as the outer diameter of the normally non-compressed and non-expanded tubular member 40 so as to axially support the same; however, the inner diameter of axially extending bore-defining wall portion 62, of body member 12, which is interposed between axially extending wall portion 60 and divergent wall portion 42, of body member 12, and is disposed at an axial position substantially corresponding to that of aperture 46, is somewhat larger than that of portion 60 and normal outer diameter of tubular member 40 in order to accommodate the increased lateral dimension of tubular member 40 when the same is radially compressed by means of projection 48 of lever 50.

Furthermore, in order to insure that the radial and axial expansion of the tubular member 40 begins at the forward portion thereof and progresses rearwardly therefrom as the same is filled with water, the tubular member 40 is provided with a weakened annular portion 64, that is, the same may have a reduced thickness relative to the remaining portions of member 40, which is disposed at an axial position which approximately corresponds to the axial disposition of the divergent rear portion 42 of body member 12, whereby such structural combination serves to attain the aforenoted goal, the divergent portion 42, as well as the tubular support member 44 of relatively large diameter permitting or accommodating such expansion of tubular member 40 while the weakened ring or band portion 64 thereof actually causes the particularly desired expansion of member 40 to initiate at such point.

In lieu of the weakened band portion 64 of tubular member 40, the member 40 might otherwise be fabricated such that the thickness of the same is gradually increased as one proceeds rearwardly along its longitudinal axis, the thinnest portion thereof being within the forward portion and particularly at the axial disposition which again substantially corresponds to the rear divergent portion 42 of body member 12. In this manner, the pressure of the liquid within the tubular member will of course tend to first expand the thin, forward portion of the member 40 following which expansion will proceed axially along the length thereof. In either case, in order to prevent over-filling of the tubular member, or in other words, in order to perceive the fact that the member 40 is in fact filled, an arcuate slot or window 66, which may extend through an angular displacement of 180 degrees about the longitudinal axis of support member 44, is provided within the rear portion of tubular support member 44. Alternatively, the support member 44 may be fabricated of a transparent plastic material whereby the expansion of the member 40 may be visibly perceived throughout its filling process.

While the expansible member 40 has been disclosed as an axially extending tube, the same might alternatively be a radially disposed diaphragm-type member, or any other appropriate element having a practical configuration for the intended purposes, not shown, whereby expansion of the same during the filling process is similarly accomplished by means of the water pressure acting thereagainst. In addition, while the member 40 has also been disclosed as being made of, for example, a suitable rubber material, the same could likewise be fabricated of a suitable thermoplastic material which is likewise expansible and resilient. It has been experienced however, that with some thermoplastic materials, and particularly in connection with the present invention, if the member 40 were held compressed, or pinched to its closed position, by means of lever 50 and the projecting member 48 thereof, for any considerable length of time, the member 40 would tend to retain its compressed or pinched state and would not recover rapidly enough to its normal circular, cross-sectional configuration upon release of the lever 50 and projection 48. The result of such would be that the flow of water during discharge would be partially impeded and the resulting stream would be weak and turbulent. Consequently, if thermoplastic material is used for member 40, suitable means, not shown, might also be provided to hold the lever 50 and projecting member 48 to a normally open position when the squirt toy is not in use, such means taking various embodiments and configurations such as, for example, a strap or band wrapped around the rear portion of lever 50 and tubular support member 44, or alternatively, a plug or block interposed between the underside of lever 50 and the external upper surface of support member 44 or body 12 at an axial position forward of the pivot mechanism defined by brackets 52 and pin 54, or still alternatively, apertures may be provided within the lever 50 and brackets 52, and upon such becoming aligned, corresponding to the open position of the valve mechanism, a pin may be inserted therethrough in order to retain the same in its open position.

It should also be noted at this juncture that the tubular support member 44, while providing or serving as a convenient support for the tubular member 40, also serves other functions within the apparatus of the present invention, such as, for example, in the event that bursting of tubular member 40 occurs, injury to the user of the toy apparatus is positively or effectively prevented due to the fact that the member 40 is entirely enclosed or encased within the rigid support member 44. In order to prevent the bursting of the tubular member 40 from overfilling, the total volume of the support member 44 is simply made substantially less than the bursting volume of the expansible member 40, such being accomplished, for example, by making the inside diameter of the support member less than the diameter to which the tubular member 40 would normally expand if unrestrained, the length of member 44 being also of a correspondingly relative value.

In addition to enabling the user to see when the tubular member is full, the window means 66 also provides an opening for inserting the tubular member 40 into, or removing a burst tube from, the apparatus. Still further, as noted hereinabove, due to the rigidity of the member 44, and its enclosure or encasement of the expansible member 40, the latter is adequately protected against cuts and abrasions which may normally occur through use of the toy apparatus and which may otherwise be imparted to the expansible member 40, if the rigid member 44 were not provided, whereby the expansible member might be punctured or cut, such thereby tending to burst the same.

Figure 2:
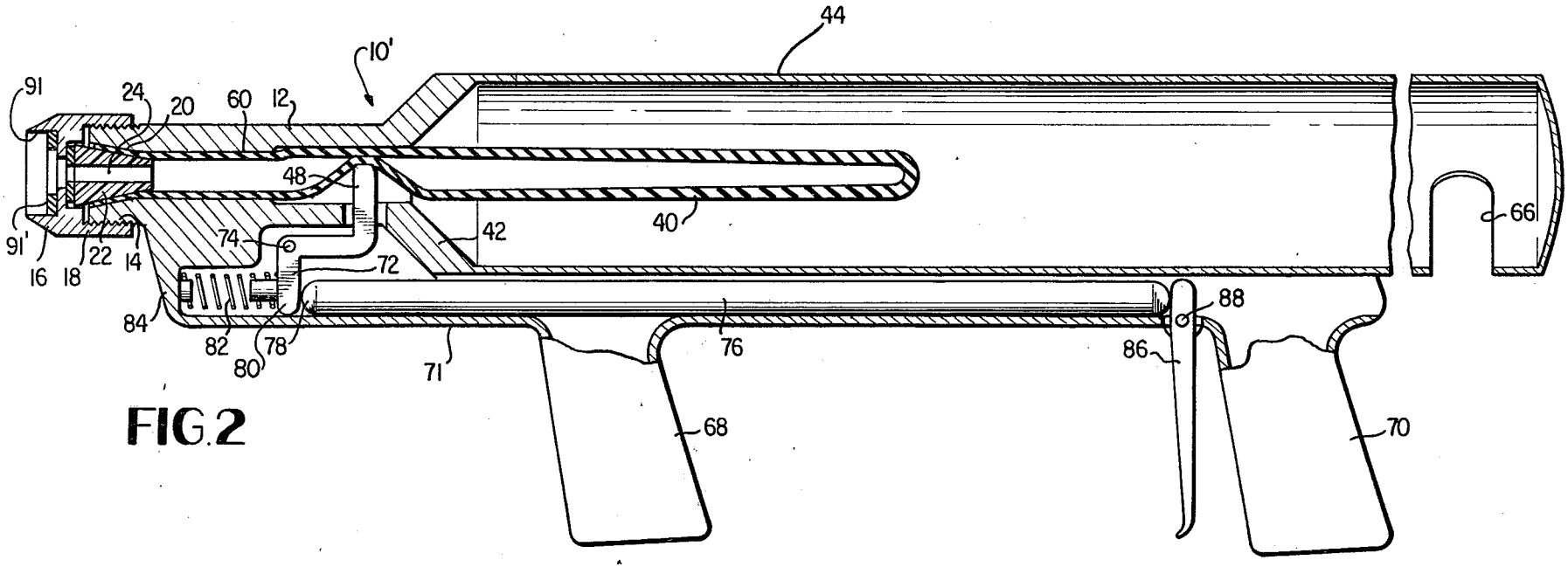
FIG. 2 is a schematic view of a modified embodiment of the water squirt toy shown within FIG. 1.

Referring now to FIG. 2, there is shown a modified embodiment, generally designated 10', of the squirt toy 10 of FIG. 1, wherein, in view of the fact that substantially all of the structure of both embodiments is the same, the detailed description of this embodiment will be confined solely to the differences therebetween, which, as is apparent from the figures, resides basically within the lever actuating valve mechanism.

As will be recalled from the description of the embodiment of FIG. 1, the tubular support member 44 was a separate component from the body member 12 and during fabrication of the toy apparatus, such components were integrally secured together. Within the embodiment of FIG. 2, however, the tubular member 44 is integrally formed with the body member 12, such as, for example, by means of an injection molding process.

Body member 12 and tubular support member 44 taken together constitute the housing of water squirt toy 10 in both FIG. 1 and FIG. 2.

In order to facilitate easy handling, particularly when the diameter of support member 44 is made large, forwardly and rearwardly disposed dependent handle-grips 68 and 70 may be integrally formed with an additional housing 71 which may be likewise integrally formed with the lower peripheral surface of support member 44, along the longitudinal axis thereof, so as to be disposed externally of member 44 whereby the lever actuating valve mechanism will be within additional housing 71. More particularly, the projection member 48 is seen to be integrally formed as part of a substantially Z-shaped lever 72 which is pivotably mounted within the forward end of the housing 71 by means of a pivot pin 74, and an actuating bar 76, axially slidable within the housing 71, has one end 78 thereof which engages the end 80 of lever 72, so as to actuate the same.

A coil spring 82 is interposed between the end 80 of lever 72 and the forward end wall 84 of housing 71 for biasing the return of actuating bar 76 to its non-actuated position and simultaneously biasing lever 72 into the closed position wherein its projection 48 pinches tube 40. A dependent, elongated finger-actuated trigger mechanism 86 is also pivotably secured within housing 71, by means of pivot pin 88, at a position adjacent handle-grip 70, and the upper end thereof engages the rear end of bar 76. In this matter, as the trigger mechanism 86 is moved in the conventional manner by means of an operator's fingers, it will pivot about pivot pin 88 and the upper end thereof will move bar 76 toward the left as viewed within the figure, whereby the latter will in turn actuate lever 72 so as to cause the same to pivot about pin 74 whereby projection 48 will permit the opening of the tube 40 and thereby release the water contained therein.

It will also be seen from FIG. 2 that in lieu of the tubular member 40 having the weakened portion 64, the member within the embodiment of this figure is disclosed as having a tapered wall thickness which gradually gets thicker as one proceeds rearwardly along member 40, all in a manner as previously disclosed for achieving the particularly noted purposes. An alternative embodiment to the nose piece 16 of FIG. 1 is disclosed in FIG. 2 as including an axially extending counterbored portion 91 having a diametrical extent substantially larger than flanged portion 30, an additional annular gasket 91' being seated within bore 91 and against the forward wall portion of nose piece 16 which partially defines flanged portion 30.

With counterbore 91 of appropriate diameter, the water squirt toy 10' may be fluidically mated directly with a conventional hose bib or hose without the need of a special fillvalve as disclosed hereinafter. Alternatives to this straight bore 90 would be a tapered bore, for fitting over said hose bib or hose, or a tapered or straight nose piece sized to fit inside such hose bib or hose. It is to be additionally appreciated that while the tapered member 40, the modified nosepiece 16, and the integral molding of body member 12 and support member 44 having been disclosed within the embodiment of FIG. 2, such structural features are equally applicable to the embodiment of FIG. 1.

Figure 3:
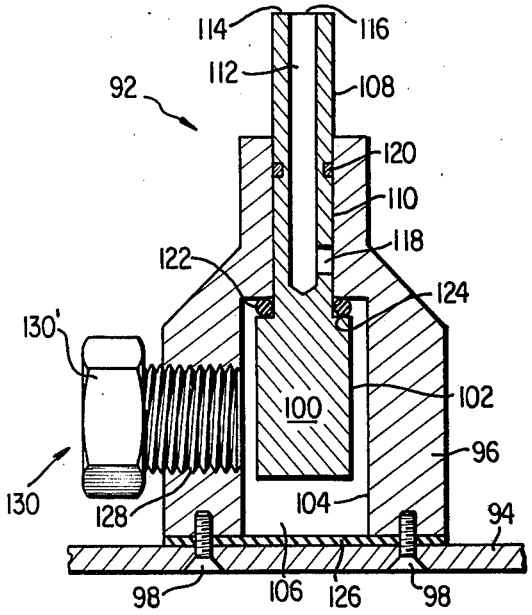
FIG. 3 is a cross-sectional view of one embodiment of a filling-valve constructed in accordance with the present invention and showing its cooperative parts, the same being usable for filling the water reservoir of the water squirt toy of FIG. 1.

With particular reference now being made to FIG. 3, a filling valve, generally indicated by the reference character 92, which is particularly adaptable for use with the squirt toys of FIGS. 1 and 2 is disclosed as a housing including a plate-type base 94 which may have a circular configuration and a substantially annular stepped upper portion 96 upstandingly secured to the base by suitable fastening means 98, and a stepped cylindrical stem 100 co-axially and slidably disposed within the housing upper portion 96. The outer diametrical extent of the large diameter portion 102 of stem 100 is seen to be substantially smaller than the inner diametrical extent of the large diameter portion 104 of housing 96, and consequently, a substantially cup-shaped fluid chamber 106 is defined within housing upper portion 96 and between the same and stem portion 102.

The outer diametrical extent of the small diameter portion 108 of stem 100 is seen to be substantially the same as, or slightly less than, the inner diametrical extent of the smaller diameter portion 110 of housing upper portion 96 whereby the slidable disposition of stem 100 within housing upper portion 96 is established. Portion 108 of stem 100 is provided with an axially extending blind bore 112 which is open within the upper surface 114 of stem portion 108 so as to define a discharge port 116 therein, and is further provided with a radially extending blind bore 118 which fluidically connects the lower external peripheral surface of stem portion 108 with bore 112.

An O-ring member 120 is disposed about the external periphery of stem portion 108 at an axial disposition above radial bore 118 so as to fluidically seal the interface defined between stem portion 108 and housing portion 110 and disposed above bore 118, and another O-ring member 122 is seated upon the annular shoulder 124 defined between the large and small diameter portion of the stem 100 so as to similarly fluidically seal the interface defined between stem portion 100 and the adjacent housing portion and disposed below bore 118 and prevent water leakage from fluid chamber 106. A flat, disc-type gasket 126 is also interposed between the base 94 and the base portion of the housing 96 so as to likewise prevent leakage of water outwardly from chamber 106.

Figure 4:
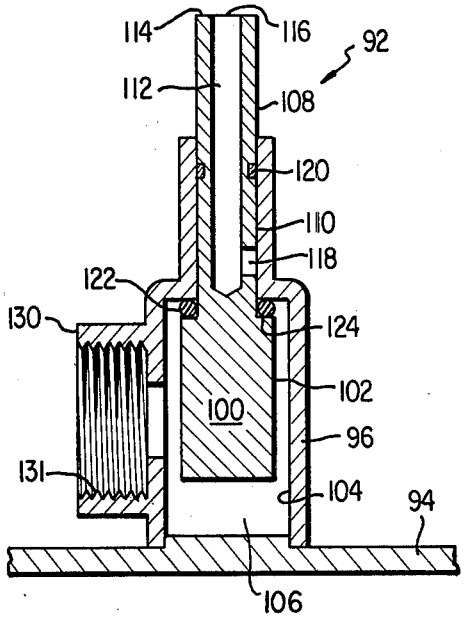
FIG. 4 is a view similar to that of FIG. 3, showing however another embodiment of a filling-valve.

An internally threaded bore 128 is also provided within sidewall portion of the housing and an externally threaded annular hose fitting 130, having internal threads, not shown, within the head portion 130' thereof for mating with a hose is threadedly engaged therein, although, of course, the fitting 130, having internal threads 131 for mating with a hose, might be integrally formed with the housing, as seen within FIG. 4. In this manner, a hose, not shown, may be threadedly engaged within fitting 130 whereby water may be supplied to the valve 92 through means of fitting 130, the water being initially accumulated within chamber 106. It will be noted that the stem 100 is merely slidably disposed within housing 96, and consequently, the water pressure within chamber 106 merely biases the stem 100 upwardly within the housing 96 whereupon the bore 118 becomes disposed within the small diameter portion 110 of the housing upper portion 96, fluid flow out of discharge port 116, through means of bores 118 and 112, is terminated. Alternatively, of course, the stem 100 may be spring biased upwardly to the closed position, and various other modifications are available as well.

In utilizing the filling valve in conjunction with the squirt toy of FIGS. 1 and 2, the squirt toy 10 or 10' is simply mated with the filling valve 92 such that the nosepiece 16 will engage the upper portion of stem 100, and more particularly, the end face 114 of stem 100 will contact gasket 36, and upon pushing downwardly, the stem 100 is forced axially inwardly with respect to housing upper portion 96 whereby the radial bore 118 is uncovered thereby permitting water to flow therethrough into bore 112 and out of discharge port 116 whereby the same will enter the discharge opening or bore 24. In order to facilitate the squirt toy 10, and more particularly, the tubular member 40 thereof, to be filled, lever 50 will be simultaneously manually pivoted about its pivot pin 54 so as to withdraw projection member 48 from its closed or pinching position with respect to the member 40, and consequently water will enter tubular member 40 thereby resiliently expanding the same, it being noted however that the fluid pressure would probably be sufficient to overcome the biasing force of spring 58 without manual operation of lever 50. The expansion of member 40 may of course be monitored through means of the window 66, and upon the member 40 reaching the axial position at which window 66 is disposed, the squirt toy 10 is removed from valve 92 to terminate the filling and simultaneously lever member 50 is released so as to permit projection member 48 to again close tube 40 thus completing the filling operation. Obviously, in filling water squirt toy 10', trigger mechanism 86 is actuated to withdraw projection member 48 to achieve the same results described with respect to water squirt 10.

It is to be noted that the outer diametrical extent of stem portion 108 is substantially the same as or slightly smaller than the inner diametrical extent of nose portion 32 so as to facilitate proper mating therebetween, and similarly, the diametrical extent of bore 112 may be substantially the same as that of the gasket 36 and bore 24, whereupon axially aligning bores 112 and 24, fluid flow from the valve 92 and into the bore 24 is facilitated, although it is to be noted that with different cones 22, different sized bores 24 will be disposed within the toy, such however, not rendering the filling operation inoperative. Still further, it is also noted that tip portion 132 of nosepiece 16 is tapered radially inwardly as one proceeds rearwardly along the longitudinal axis of the squirt toy 10, and such portion 132 therefrom serves as a piloting means for guiding the insertion of stem portion 108 of filling valve 92 into the nose piece 16 during a filling operation. Alternatively, of course, the stem portion 108 could be tapered or flared for such purpose.

Similarly, while the gasket 36 has been disclosed as being disposed within the nose piece 16, such structure could alternatively be disposed upon the valve stem portion 108. Still further, while the gasket has also been disclosed as a disc-type gasket, an O-ring member, or a tapered seal member may alternatively be employed. Still yet further, the gasket may be entirely eliminated if one or both of the cone or stem members is formed of a somewhat deformable material whereupon sufficient force being applied therebetween during mating of the same, the material will deform and provide a sealing function therebetween, and as a further possible modification, the cone 22 might be integrally formed with the nose piece 16.

Still further, the gasket 120 may be entirely eliminated if a circumferential ridge is formed integrally in its place on stem portion 108 and either one or both of the stem 108 or the housing is formed of a material that is sufficiently deformable to provide a sliding seal.

Similarly, gasket 122 may be eliminated if either one or both of the stem 108 or the housing is formed of material that is sufficiently deformable, and annular shoulder 124 is suitably configured so that a seal results without a gasket.

While the embodiments of the toys disclosed within FIGS. 1 and 2 also disclose the fact that the filling of the toy, and more particularly the tubular member 40 thereof, is accomplished through means of the discharge opening 24 of cone 22, a separately valved intake port, not shown, may of course be provided within body member 12 or support member 44, and in this manner, filling of tubular member 40 may be accomplished more rapidly, particularly when using a cone having a small bore 24. In addition, in order to alter the discharge characteristics and parameters of the expelled stream of water, various cones 22 having different diameter bores 24 of course be installed within the toy apparatus 10, and improvement of the discharge stream characteristics may be accomplished by using the apparatus shown within FIGS. 5 and 6.

Figure 5:
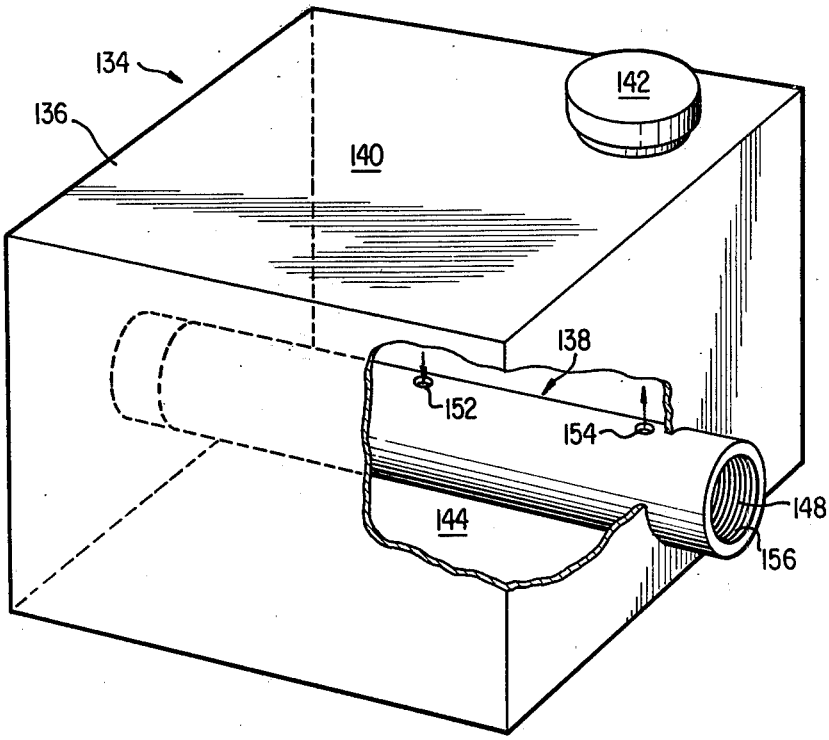
FIG. 5 is a perspective view of one embodiment of an injector apparatus for use with the filling valve of FIG. 3 or FIG. 4 and/or the water squirt toy of FIG. 1 or 2.
Figure 6:
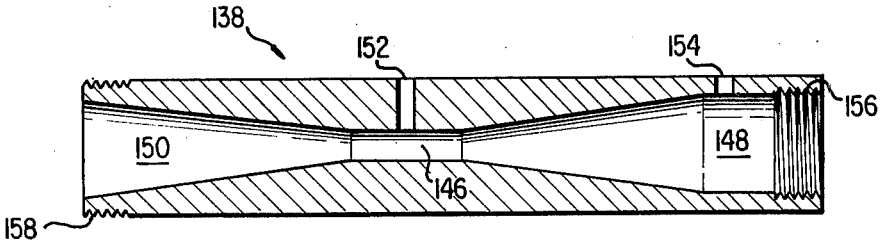
FIG. 6 is a fragmentary, cross-sectional view of the injector apparatus of FIG. 5.

Referring then to FIGS. 5 and 6, an injector, generally indicated by the reference character 134, is disclosed as including a housing 136, which may have the configuration of a rectangular solid, within which a Venturi tube, generally indicated by the reference character 138, is suitably fixedly disposed. The top wall 140 of housing 136 is provided with a filling port which is capable of being closed by means of, for example, a plug 142 threadedly engaged therewithin, and in this manner, a closed chamber 144 is defined within the housing 136.

As seen within FIG. 6, the Venturi tube 138 includes the conventional constricted throat portion or passageway 146 which is of course fluidically connected to the upstream and downstream passageways 148 and 150, respectively, which are, of course, of substantially larger diameter. Radial passageways 152 and 154 provide fluidic communication between the throat passageway 146 and the upstream passageway 148 respectively, and the chamber 144, and the upstream and downstream ends 156 and 158 of the Venturi tube 138 are threaded internally and externally, respectively, so as to provide threaded connections with hose members, not shown, leading to a source of water, and to the filling valve 92, respectively.

Suitable liquid chemicals, solutions, dispersions, or emulsions, such as, for example, polyethylene oxide, or a polyacrylamid, are deposited within the housing chamber 144, and in this manner, as water is conducted through the Venturi tube 138, the resulting pressure difference established between passageways 152 and 154 cause the liquid chemicals from chamber 144 to enter the water stream, flowing through the throat passageway 146 toward the discharge passageway 150, by means of the radial passageway 152 while a limited amount of water entering passageway 148 is introduced into chamber 144 by means of radial passageway 154. The aforenoted chemicals, when added in relatively small amounts to water give the water a characteristic called "pituitousness" which is a tendency to coalesce and become "stringy." This characteristic enhances the laminar flow characteristics of the water resulting in reduced stream separation, reduced frictional flow, and increased range whereby the water may in fact be discharged over great distances than normally possible. It is to be noted that while the water entering chamber 144 through means of passageway 154 tends to somewhat dilute the chemicals present within the chamber 144, the degree to which such is in fact diluted is not such as to effectively deleteriously affect the aforenoted properties of the water discharged from passageway 150 until an extended period of time has elapsed.

Figure 7:
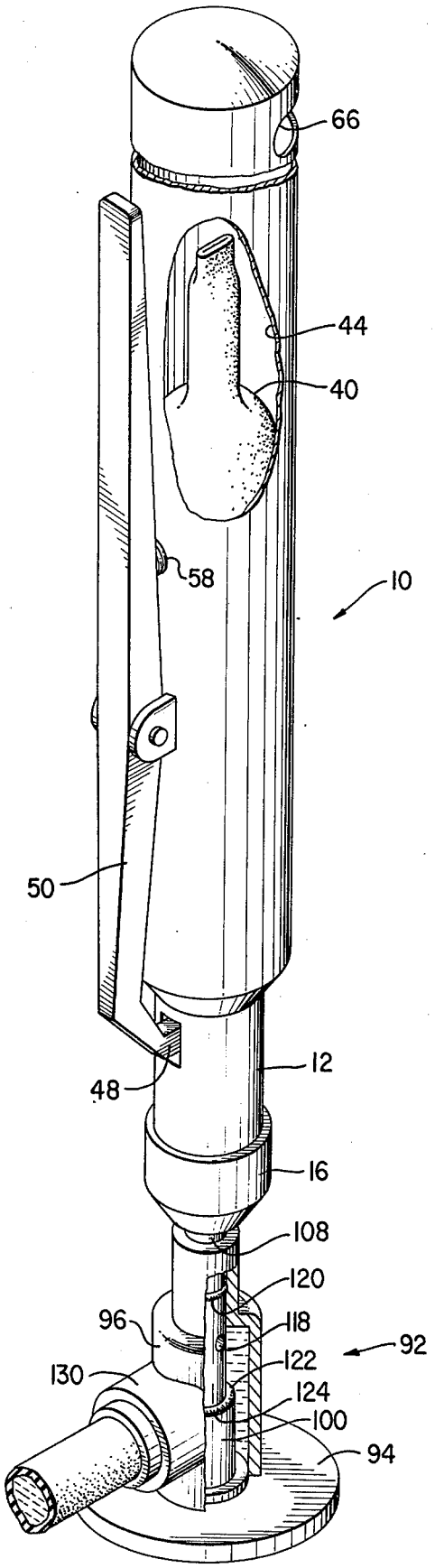
FIG. 7 is a perspective view of cooperative mating of the water squirt toy of FIG. 1 and the filling valve FIG. 4 during the filling operation.

With particular reference now being made to FIG. 7, there is illustrated the cooperative mating of the water squirt toy 10 and filling valve 92 during the filling operation. Lever 50 is shown in the open position to facilitate filling, expansible tubular member 40 is shown partially expanded and filled with water, and stem 100 of the filling valve 92 is shown depressed in the open position by the water squirt toy 10. An ordinary garden hose is shown attached to fitting 130 of filling valve 92. The other end of the garden hose (not shown) is attached either to an open hose bib or to the injector 134 which is in turn attached to an open hose bib.

Figure 8:
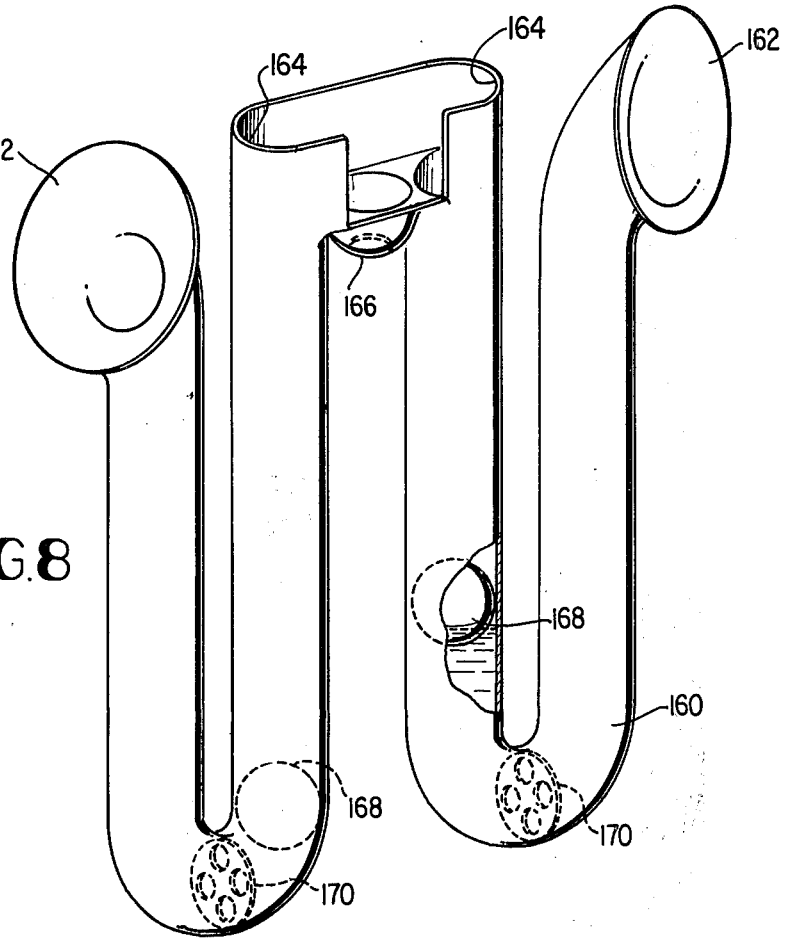
FIGS. 8–10 are perspective views of different amusement apparatus with which the water squirt toy apparatus of FIG. 1, 2, and 7 is usable.

With reference now being made to FIG. 8, one embodiment of an amusement apparatus which may be operated or used in conjunction with the squirt toy 10 of the present invention is disclosed as comprising two substantially U-shaped tubes 160 having funnel members 162, integrally formed upon the upper ends of one of the legs thereof, which serve as intake means for a stream of water discharged from a device such as the squirt toy 10. The upper end portions of the other legs of the tubes 160 are provided with arcuate cut-out portions 164, and the tubes 160 are fixedly disposed adjacent each other with a suitable, cup-shaped receptacle 166 interposed therebetween. Receptacle 166 has an opening in its bottom to permit water to drain out of it.

Balls or spheres 168, which will float on water, are disposed within the tubes 160, mesh members 170 being disposed within the lowermost portions of the tubes 160 in order to maintain the balls 168 within the discharge half thereof, and in this manner, as water is conducted into the tubes 160 through means of the funnels 162, the water will gradually fill the tubes 160, pass through the mesh members 170, and force the balls 168 to float and exit from the tubes through means of the arcuate openings 164. The balls 168 will then of course be deposited within the receptacle 166, and therefore, the first player to seat his ball within the receptacle 166 is the winner.

The tubes may be formed of transparent material so that the position of the water level and balls may be observed during the play of the game. Alternatively, the tubes may be formed of non-transparent material. Obviously, the funnel member portion of tube 160 should be higher than the discharge portion of tube 160 to provide adequate head to cause the water to discharge at 164.

Figure 9:
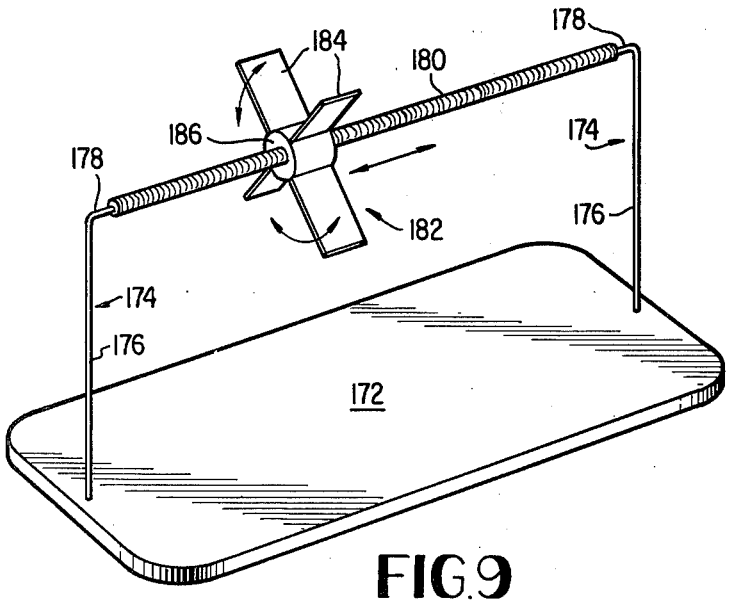

Another amusement apparatus constructed in accordance with the present invention is disclosed within FIG. 9 and is seen to include a base member 172 upon which is fixedly secured a pair of upstanding support members 174 longitudinally spaced apart along the longitudinal axis of base 172. The support members 174 include vertically disposed rod members 176 fixed to base 172, and horizontally disposed rod members 178 integrally formed at the upper ends of member 176 so as to project toward each other. A threaded rod 180 is fixedly secured to, and interposed between, members 178, and one or more paddle-wheel type elements 182 are threadedly engaged upon rod 180. The paddle-wheel 182 includes a plurality a blade members 184 fixedly secured to a central hub 186, the latter of which is rotatably threaded upon rod 180, and upon water being directed upon the blades 184 of the paddle-wheel 182, by means of two or more players, the latter will be forced to rotate upon rod 180 in either of the two directions, whereby the first player to cause wheel 182 to reach his designated end of rod 180 is the winner.

Figure 10:
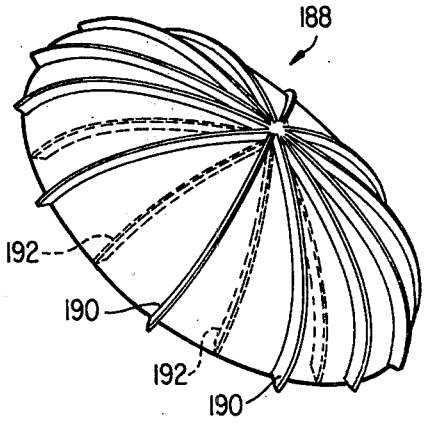

With reference now being made to FIG. 10, a third amusement apparatus constructed in accordance with the present invention is disclosed, and the same is seen to be a saucer-type flying device, generally indicated by the reference character 188, and as is conventional, is seen to have a dome or cupola type configuration. The upper external surface thereof is provided with a plurality of radially extending, upstanding ribs 190 spaced equiangularly about the circumference of the device, while the interior surface thereof is similarly provided with a plurality of radially extending, dependent ribs 192 similarly spaced thereabout.

In utilizing the saucer 188 in conjunction with the squirt toy 10 of FIGS. 1 and 2, two players, each required to stay within separate fixed areas, throw and catch the saucer 188 back and forth between them. In addition, one or more additional players equipped with means for squirting water direct streams of water at the saucer 188 and by striking the same, particularly the ribbed members 190 and 192 thereof, with the water streams, attempt to shoot down the saucer so as to prevent the same from being caught.

Obviously, many modifications and variations of the present invention are possible in light of the above teachings. It is therefore to be understood that within the scope of the appended claims, the invention may be practiced otherwise than as specifically described herein.

What is claimed:

1. A water squirt toy apparatus comprising:

a rigid housing;

resiliently expansible and contractible water reservoir means disposed within said housing; said water reservoir means being made of an elastically expansible material to permit expansion under fluid pressure of the surface area of said water reservoir means and having means thereon for causing expansion of said water reservoir means to initiate at a forward portion thereof, said rigid housing being of such dimensions that the expanded portion of said water reservoir means remains solely within said housing when said water reservoir means is in expanded condition.

spring biased valve means attached to said rigid housing and operatively associated with said water reservoir means for permitting or preventing discharge of water from said water reservoir means;

water discharge means fluidically connected to said water reservoir means for discharging the water therefrom when said valve means is opened; and a portable fill-valve means actuatable to an open and closed position and having connection means thereon adapted to connect said fill-valve means physically and fluidically to an otherwise open source of water under pressure, said fill-valve means being normally separate from said water reservoir means and said rigid housing means and being capable of being fluidically mated with said water discharge means for controlling the filling of said water reservoir means from said water source when said fill-valve means is actuated to said open position.

2. A squirt toy apparatus as set forth in claim 1 wherein:

said water reservoir means is a tube closed at one end thereof.

3. A squirt toy apparatus as set forth in claim 2 wherein:

said valve means includes means for pinching said tube.

4. A squirt toy apparatus as set forth in claim 3, wherein said pinching means comprises a spring biased lever which engages said tubular reservoir means and which normally compresses and pinches said tube to a closed state.

5. A squirt toy apparatus as set forth in claim 2 wherein said tube includes said means for causing expansion of said water reservoir means.

6. A squirt toy apparatus as set forth in claim 5 wherein said expansion initiation means comprises said tube having a non-uniform wall thickness.

7. A squirt toy apparatus as set forth in claim 6 wherein said non-uniform means is an annular portion of said tube having a thickness less than the thickness of the remainder of the expansible portion of said tube and located at the point of desired initial expansion.

8. A squirt toy apparatus as set forth in claim 2, further comprising:

holding means for securing said reservoir means within said housing.

9. A squirt toy apparatus as set forth in claim 8, wherein said holding means comprises:

said water discharge means and a portion of said housing which mates with said water discharge means, a portion of said reservoir means being interposed between said mating discharge means and said housing portion so as to be fixedly secured within said housing.

10. A squirt toy apparatus as set forth in claim 1, wherein:

said water discharge means is removable from said housing so as to facilitate removability and replacement of said reservoir means, as well as the replacement of said discharge means thereby facilitating alteration of the discharge characteristics of said discharge means.

11. A squirt toy apparatus as set forth in claim 1, wherein said fill-valve means comprises:

a valve housing having an inlet port defined therein; and a discharge means; and stem means for controlling the flow of water through said fill-valve means, having a discharge port defined within one end thereof, reciprocably disposed within said housing between an open position at which said discharge port is fludically connected to said inlet port means, and a closed position at which said inlet port is fluidically disconnected from said discharge means.

12. A squirt toy apparatus as set forth in claim 11, wherein said stem means of said fill-valve means is biased to its closed position by means of water pressure.

13. A squirt toy apparatus as set forth in claim 11, wherein said stem means of said fill-valve means is biased to its opened position by a force applied by a portion of the water squirt toy apparatus.

* * * * *